United States Patent [19]

Langmeier et al.

[11] Patent Number: 4,807,787

[45] Date of Patent: Feb. 28, 1989

[54] EASY-OPEN/RECLOSURE DEVICE HAVING DEFORMABLE POUR SPOUT

[75] Inventors: James R. Langmeier, Hamilton, Ohio; Mohamed N. H. Chehab, Brussels; Robert C. J. M. De Caluwé, Londerzeel, Belgium; Willy A. M. Hertogs, Sint Katelijne Waver, Belgium; Jean B. A. Van den Broeck, Asse, Belgium; Miriam H. J. M. van Loon, Mol, Belgium

[73] Assignee: The Procter & Gamble Company, Cincinnati, Ohio

[21] Appl. No.: 114,174

[22] Filed: Oct. 27, 1987

Related U.S. Application Data

[63] Continuation-in-part of Ser. No. 48,867, May 12, 1987, abandoned.

[51] Int. Cl.[4] ..... B65D 47/08

[52] U.S. Cl. ..... 222/529; 222/537; 222/541; 222/569; 220/85 SP

[58] Field of Search ..... 222/526, 527, 528, 529, 222/537, 566, 567, 569, 570, 546, 575, 541, 90; 220/85 SP

[56] References Cited

U.S. PATENT DOCUMENTS

| | | | |
|---|---|---|---|
| RE 21,310 | 12/1939 | Mackey | 221/11 |
| 1,301,868 | 4/1919 | Nowack . | |
| 1,457,614 | 6/1923 | Brown . | |
| 1,473,453 | 11/1923 | Wunderlich | 222/528 X |
| 1,611,111 | 12/1926 | Frazier et al. . | |
| 1,726,090 | 8/1929 | Von Briesen et al. | 222/528 X |
| 1,881,403 | 10/1932 | Guyer | 220/85 SP X |
| 1,944,058 | 3/1934 | Barnes et al. | 221/11 |
| 1,952,674 | 3/1934 | Karsel | 221/23 |
| 1,987,055 | 1/1935 | Dival | 221/23 |
| 2,016,964 | 10/1935 | Lluffman | 222/81 X |
| 2,098,763 | 11/1937 | Sebell | 221/11 |
| 2,171,094 | 8/1939 | Livoti | 220/85 SP |
| 2,243,636 | 5/1941 | Kraetch | 65/31 |
| 2,248,879 | 7/1941 | Kraetch | 65/31 |
| 3,081,912 | 3/1963 | Goceliak | 222/567 X |
| 3,113,706 | 12/1963 | Wickman | 222/543 |
| 3,204,829 | 9/1965 | Song | 222/546 X |
| 3,207,377 | 9/1965 | Lenielson | 222/567 X |
| 3,217,951 | 11/1965 | Paal | 222/528 |
| 3,913,782 | 10/1975 | Cass | 220/260 |
| 3,938,693 | 2/1976 | Patel et al. | 220/267 |
| 4,054,205 | 10/1977 | Blow, Jr. et al. | 206/217 |
| 4,240,568 | 12/1980 | Pool | 222/189 |
| 4,480,763 | 11/1984 | Schneider | 220/269 |
| 4,582,216 | 4/1986 | Byrd | 220/260 |

FOREIGN PATENT DOCUMENTS

| | | | |
|---|---|---|---|
| 132419 | 7/1951 | Sweden | 220/85 SP |

*Primary Examiner*—Joseph J. Rolla
*Assistant Examiner*—Nils E. Pedersen
*Attorney, Agent, or Firm*—John J. Ryberg; E. Kelly Linman; John V. Gorman

[57] ABSTRACT

An easy-open/reclosure device intended to be attached to the top lid of a container having an upstanding peripheral rim. The device includes a base portion and a moveable portion preferably hingedly attached thereto. The base portion has a dispensing aperture, a depending flange encircling the aperture, and a deformable pouring lip/drain surface. The moveable portion has a depending plug member which is shaped complementary to the base portion's aperture for reclosing the container. When the device is applied to the container, the base portion's depending flange is pushed through a prescored or pre-cut aperture in the container's top lid. In applying the device to the container, the container's peripheral rim bends the base portion's deformable pouring lip/drain surface upward and inward such that it assumes an inclined, trough-shaped configuration. This resultant shape provides an excellent surface for both channeling product up and over the container's peripheral rim when the container is tipped as well as for channeling any residual product remaining on this surface back into the container when it is returned to its upright position.

23 Claims, 2 Drawing Sheets

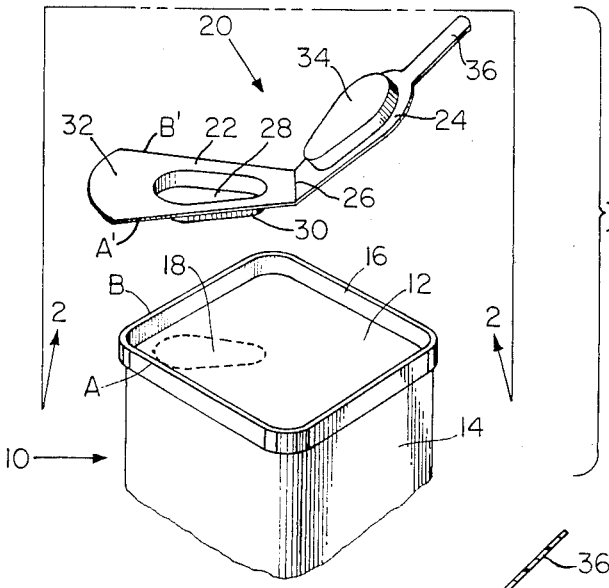
Fig. 1
Fig. 2
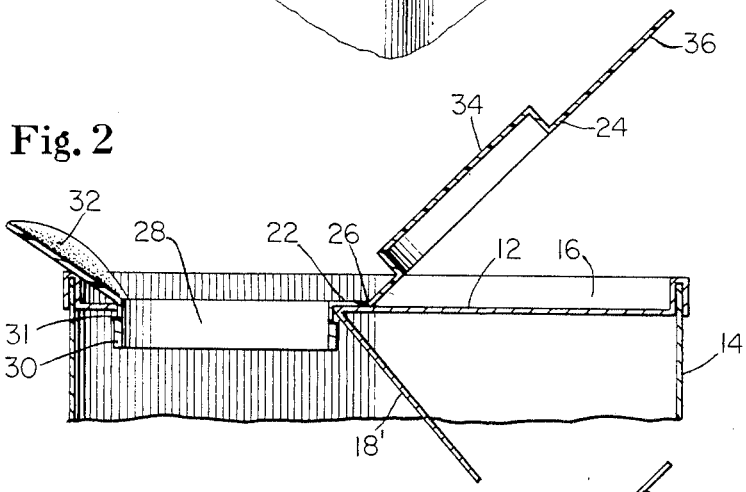
Fig. 3
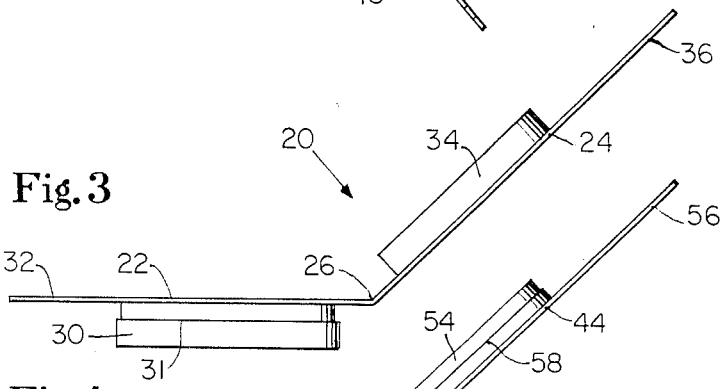
Fig. 4
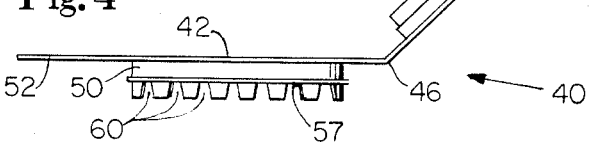

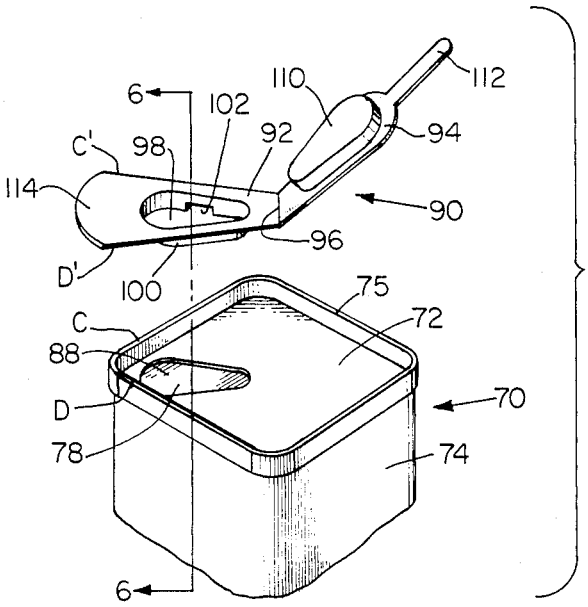
Fig. 5
Fig. 6
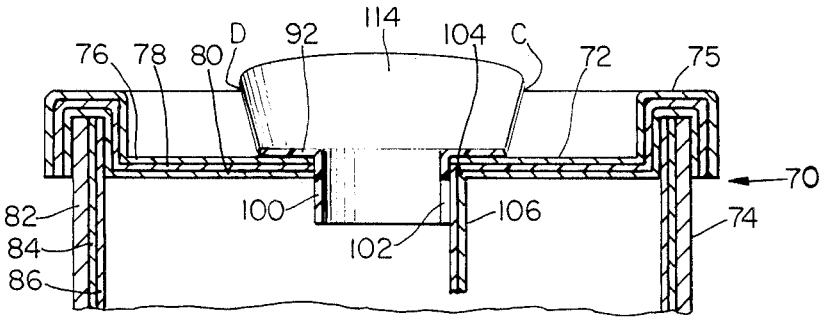
Fig. 7
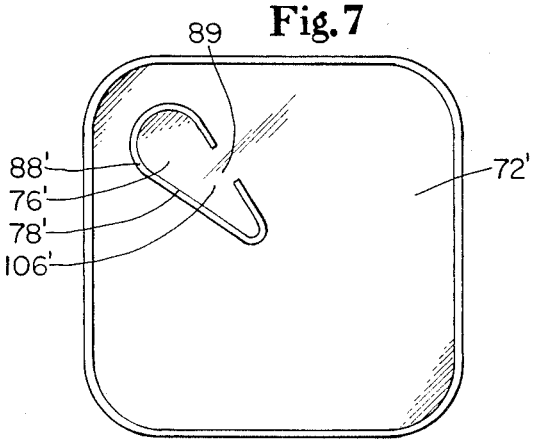

EASY-OPEN/RECLOSURE DEVICE HAVING DEFORMABLE POUR SPOUT

This is a continuation-in-part of Ser. No. 48,867, filed on May 12, 1987, now abandoned.

TECHNICAL FIELD

The present invention pertains to easy-open/reclosure devices for containers, and more particularly to easy-open/reclosure devices that are intended to be applied to the top lid of a beverage container having a peripheral rim.

BACKGROUND OF THE INVENTION

For the user's convenience, most beverage containers are provided with some type of easy-opening feature, examples of which include a pre-scored pull tab in the container's lid or an adhesive tape covering a pre-cut dispensing aperture. These types of easy-open beverage containers are generally acceptable if the container's contents are entirely consumed or dispensed shortly after opening. However, in instances where the container's contents are only partially consumed and stored, these containers are objectionable and inconvenient because they cannot be reclosed. The absence of a reclosing feature not only makes it difficult to keep the container's contents fresh and foreign matter such as dirt and dust from entering the container, but also makes it very difficult and awkward to shake the container to evenly redistribute solids if present such as juice pulp.

Recent attempts to provide an easy-open beverage container with reclosing means have only achieved partial success. One such attempt is generally shown in U.S. Pat. Nos. 4,164,303 and 4,232,797, both to Waterbury. Waterbury discloses several embodiments of an articulated closure element that is hingedly attached to the top lid of a container having a peripheral rim. The closure element has a depending plug or bead on its undersurface that is shaped complementary to a pre-cut dispensing aperture in the container's lid. After the container is initially opened and a portion of its contents dispensed, the container may be reclosed by returning the closure element to its original position such that the depending plug or bead enters the dispensing aperture.

Although Waterbury's articulated closure element does allow a rimmed beverage container to be reclosed after it is initially opened, consumers nevertheless find this general type of reclosable container to be objectionable. Specifically, when a portion of the beverage is dispensed, some of the beverage inevitably becomes trapped between the container's dispensing aperture and upstanding rim. After the container is returned to its upright position, this residual tends to spread out over the container's lid and, if the beverage is sweet such as a fruit juice, dries to a sticky mess that attracts dust, dirt, insects, and other foreign matter.

FIG. 7 of commonly-assigned U.S. Pat. No. 4,582,216 to Byrd illustrates a pouring/reclosing device that is intended to be attached to a container's top lid after the container has been opened. In addition to having a reclosing feature, Byrd's device includes a downwardly-projecting, U-shaped flange in the base portion that receives and snugly engages the container's upstanding rim when the device is applied to the container's top lid, and a pouring lip/drain surface integrally formed between the base portion's dispensing aperture and the downwardly projecting U-shaped flange. After Byrd's device is secured to a rimmed beverage container's lid and the container is tipped, the integral pouring lip/drain surface channels the container's contents up and over the top lid's peripheral rim. Then, when the container is returned to its upright position, the integral pouring lip/drain surface channels any residual product remaining between the top lid's peripheral rim and dispensing aperture back into the container, thereby avoiding the messiness problem discussed above.

Although consumers generally approve of the Byrd reclosing device, it has been found that in some instances it is somewhat difficult to attach the device to rimmed containers that have been manufactured in a certain fashion. Specifically, it has been found that for container bodies and lids made and assembled in a high-speed manufacturing setting such as that described in commonly-assigned U.S. Pat. No. 4,562,936 (Deflander), which is incorporated herein by reference, the location and orientation of the lid's pre-cut or pre-scored dispensing aperture with respect to the periperal rim can vary. If the variation is too great, either the reclosing plug of Byrd's device fits the lid's aperture while the downwardly projecting U-shaped flange does not precisely fit the peripheral rim, or vice-versa.

In light of the above, a principal object of the present invention is to provide a rimmed container with an attachable device that can be used to reclose an easy-open container for subsequently storing any remaining beverage and, if applicable, allow the container to be shaken in order to evenly redistribute solids such as fruit pulp.

Another principal object of the present invention is to provide a rimmed container with a device that channels the container's contents up and over the container's rim when the container is tipped and also channels any residual product remaining between the rim and the dispensing aperture back into the container when the container is returned to its upright position.

A further object of the present invention is to provide a rimmed container with a reclosing device that has a flexible pouring lip which, when the device is applied to the container's top lid, deforms into a pouring/drain-back surface that is independent of the location and orientation of the container's dispensing aperture with respect to the top lid's peripheral rim.

Another object of the present invention is to provide a container having a pre-scored dispensing aperture with a device that can be used to initially open the container.

Other objects, advantages, and novel features of the present invention will become apparent to those skilled in the art from the following detailed description, drawings, and appended claims.

SUMMARY OF THE INVENTION

In a particularly preferred embodiment of the present invention, an easy-open/reclosable device is provided for a container having an upstanding peripheral rim running around the container's top lid. The device includes a base portion and a moveable portion preferably hingedly attached thereto. The base portion has a dispensing aperture, a depending flange encircling the aperture, and a deformable pouring lip/drain surface. The device's moveable portion has a plug member depending therefrom that is shaped complementary to the aperture in the base portion. When the device is applied to the container and the moveable portion is in its closed position, the plug member enters and snugly fits within the base aperture, thereby reclosing the container.

In applying the device to the container's top lid, the flange depending from the base member is pushed through a prescored dispensing aperture in the container's top lid, or snugly pressed into a pre-cut dispensing aperture that was initially covered by, for example, an adhesive tape tab. As the device is further pressed onto the container's top lid, the container's peripheral rim comes into contact with the base portion's deformable pouring lip/drain surface and bends it upward and inward such that it assumes an inclined, trough-shaped configuration. This resultant shape provides an excellent surface for channeling product up and over the container's peripheral rim when the container is tipped. In addition, the deformed pouring lip/drain surface channels any residual product remaining on this surface back into the container when it is returned to its upright position.

BRIEF DESCRIPTION OF THE DRAWINGS

While the specification concludes with claims that particularly point out and distinctly claim the present invention, it is believed that the present invention will be better understood by reading the following detailed description with reference made to the following drawings in which:

FIG. 1 is a perspective view of the top portion of a rimmed container and an easy-open/reclosure device of the present invention shown before it is applied to the container's top lid;

FIG. 2 is an enlarged cross-sectional view of the container and easy-open/reclosing device shown in FIG. 1 taken at a point corresponding to section line 2—2, but shown with the device applied to the container's top lid;

FIG. 3 is an enlarged side view of the easy-open/reclosure device shown in FIGS. 1 and 2;

FIG. 4 is an enlarged side view of another particularly preferred embodiment of the present invention;

FIG. 5 is a perspective view of the top portion of a rimmed container of laminate construction and another particularly preferred embodiment of an easy-open/reclosure device of the present invention shown before it is applied to the container's top lid;

FIG. 6 is an enlarged cross-sectional view of the container and easy-open/reclosing device shown in FIG. 5 taken at a point corresponding to section line 6—6, but shown with the device applied to the container's top lid; and FIG. 7 is a plan view of a container's top lid having a particularly preferred pre-cut dispensing aperture.

DETAILED DESCRIPTION OF THE INVENTION

As used herein in describing the nature of a dispensing aperture in a container's top lid, the term "pre-cut" generally means an aperture that was cut completely through the top lid at the point of manufacture and initially covered or sealed by, for example, an adhesive tape tab. The term "pre-cut" is also intended to include an aperture that was cut in the outer stiff layer of a lid of laminate construction while one or more inner barrier layers are left intact such as that disclosed in commonly assigned U.S. Pat. No. 4,562,936 (Deflander), which is incorporated herein by reference. The term "pre-scored" generally means that a line of weakness was formed in the top lid by, for example, scoring the lid or the lid's outer layer if of laminate construction. It is to be understood that the present invention can be readily applied to either type of lid aperture.

Figrue 1 shows the top portion of a container generally indicated as 10, and an easy-open/reclosing device of the present invention generally indicated as 20 shown before it is applied to container 10. In this exemplary embodiment, container 10 has a generally square of rectangular cross-section with rounded corners. However, container 10 may have other cross-sectional configurations such as circular, oval, polygonal, etc.

Briefly, container 10 comprises a top lid 12 having a pre-scored or pre-cut aperture 18, a body portion 14, and a bottom lid (not shown). In a particularly preferred embodiment, container 10 is of laminate construction as shown and described in commonly-assigned U.S. Pat. No. 4,562,936 to Deflander, which is incorporated herein by reference. The top and bottom lids are attached to body portion 14 by any of several operations known to those skilled in the art of container manufacturing such as single or double seaming. Regardless of the type of manufacturing operation, device 20 of the present invention is intended to be applied to a container have an upstanding rim 16 running around the peripheral edge of top lid 12.

Referring to FIGS. 1, 2 and 3, easy-open/reclosing device 20, which is shown after it has been applied to top lid 12 in FIG. 2, generally comprises a base portion 22, a moveable portion 24, and a hinge 26 connecting the two. Alternatively, hinge 26 can be eliminate thereby making moveable portion 24 separable from base portion 22. However, the hingedly attached version of the present invention is preferred to avoid losing or misaligning moveable portion 24.

Base portion 22 includes a dispensing aperture 28 shaped complementary to lid aperture 18, and a flange 30 encircling dispensing aperture 28 and projecting downwardly from base portion 22. When device 20 is applied to top lid 12 as shown in FIG. 2, flange 30 breaks pre-scored lid aperture 18 partially along the line of weakness (the unbroken portion serving to keep broken-out section 18' from falling into the container), enters lid aperture 18, and tightly engages the aperture due to the friction fit between the two. Preferably, flange 30 has a step 31 (FIGS. 2 and 3) or a snap bead (not shown) projecting therefrom that snaps through lid aperture 18 to even more firmly secure device 20 to lid 12. The bottom edge of flange 30 may be provided with sharp teeth or serrations to reduce the amount of force necessary to press the flange through top lid 12 along the line of weakness.

Still referring to FIGS. 1, 2 and 3, moveable portion 24 includes a plug member 34 depending downwardly therefrom and a grasping tab 36 that provides a convenient means for a consumer to grasp and lift up on moveable portion 24 when it is in its closed position. Plug member 34 is shaped complementary to both base aperture 28 and lid aperture 18. When moveable portion 24 is in its closed position, plug member 34 enters and tightly engages base aperture 28, thereby providing a convenient means to reclose container 10 after the initial opening thereof.

Base portion 22 of device 20 also includes a deformable pouring lip/drain surface 32 that initially projects outwardly from base dispensing aperture 28 in substantially the same plane as base portion 22 as shown in FIGS. 1 and 3. When device 20 is first applied to top lid 12 as shown in FIG. 2, the top surface of peripheral rim 16 at approximately points A and B comes into contact with the underside of pouring lip/drain surface 32 generally at points A' and B', respectively. Then, as device 20 is further pressed onto top lid 12, contact points A and B on rim 16 start to bend pouring lip 32 upward. Finally, when device 20 is firmly seated on lid 12, rim 16 pushes the side edges of lip 32 closer to one another, which gives pouring lip 32 a trough-shaped, upwardly-inclined configuration as shown in FIG. 2. So shaped, pouring lip 32 not only provides an ideal surface for channeling product up and over rim 16 when container 10 is tipped to dispense the product therein, but also one for draining any beverage remaining on pouring lip 32 back into the container when it is returned to its upright position.

Since integral pouring lip/drain surface 32 is deformable, the location and orientation of top lid aperture 18 with respect to rim 16 are not critical. In fact, this relationship can vary considerably and yet device 20 will nevertheless fit well on top lid 12. To be deformable, base portion 22 and integral pouring lip/drain surface 32 can be made from a wide variety of deformable materials such as a thermoplastic, examples of which include polyethylene, polypropylene, polycarbonate, polyvinyl chloride, and polystyrene. Preferably, device 20 is of one piece construction made, for example, by using an injection molding technique and apparatus.

FIG. 4 illustrates the side view of another particularly preferred embodiment of the present invention. In FIG. 4, the easy-open reclosing device generally indicated as 40 includes a base portion 42, a moveable portion 44, and a hinge 46. Base portion 42 includes a dispensing aperture (not shown), a flange 50 depending from base portion 42 that encircles the base dispensing aperture, and a deformable pouring lip 52. Moveable portion 44 has a plug member 54 depending therefrom that is shaped complementary to the base aperture, and a grasping tab 56. A bead 57, which projects outwardly from flange 50, is provided to snap through lid aperture 18 and firmly secure device 40 in place when device 40 is applied to top lid 12. Similarly, a step or snap bead 58 projects from the side wall of plug member 54 that cooperates with a step or groove (not shown) on the inner surface of flange 50 to help secure plug member 54 within the aperture in base portion 42 when moveable portion 44 is in its closed position.

The bottom edge of flange 50 is provided with a series of channels 60 that serves two purposes. First, channels 60 reduce the amount of surface area of the bottom edge of flange 50 that comes into contact with pre-scored lid aperture 18 when device 40 is applied to lid 12, thereby reducing the amount of force necessary to break through lid 12 along the scored line of weakness. Second, in situations where there initially is very little headspace between the inner surface of top lid 12 and the surface level of the beverage within container 10, it has been found that only slight deformation of body portion 14 inwardly when container 10 is grasped will rapidly force product confined within flange 50 out the dispensing aperture and up onto top lid 12. Channels 60, therefore, allow fluid communication between the inside and outside of flange 50, thereby avoiding this problem, It is to be understood that channels 60 can be used to great advantage in conjunction with other easy-open/reclosure reclosure devices such as the Byrd device discussed earlier herein; accordingly, it is not intended that they be limited to only the device of the present invention.

FIGS. 5 and 6 show another preferred embodiment of the present invention that is particularly adapted to be applied to a container of laminate construction such as that described in commonly assigned U.S. Pat. No. 4,562,936 (Deflander), which is incorporated herein by reference. Briefly, the container generally indicated as 70 includes top lid 72, body portion 74, peripheral rim 75, and a bottom lid (not shown). Top lid 72 is of laminate construction comprising outer stiff layer 76 and one or more barrier layers 78 and 80. Similarly, body portion 74 and the bottom lid are also of laminate construction comprising outer stiff layer 82 and one or more barrier layers 84 and 86. Suitable materials for making outer stiff layers 76 and 82 include paper, paperboard, polyvinylchloride (PVC), polyester (PET), polystyrene (PS), polypropylene (PP), methacrylate-butadiene-styrene copolymer (MBS), or polycarbonate (PC). Suitable materials for making barrier layer 78 and 84, which is preferably substantially gas-impermeable, include aluminum or other metal foil, a metallized substrate such metallized polyolefins, metallized polyesters, etc.; or a high gas barrier plastic such as ethylene vinyl alcohol (EVAL), polyvinylidene chloride (PVDC), acrylonitrile (PAN), polyester (PET), or polyamide (PA). Suitable materials for making barrier layer 80 and 86, which preferably provides a means of sealing top lid 72 to body portion 74 as well as protecting against flavor loss and product contamination, include polyethylene (PE), polypropylene (PP), polyvinylchloride (PVC), or glycol-modified polyester (PETG).

As with top lid 12 of container 10 illustrated in FIGS. 1 and 2, top lid 72 of container 70 illustrated in FIGS. 5 and 6 includes a pre-cut or pre-scored dispensing aperture 88. In this particularly preferred embodiment, top lid 72 has an aperture 88 pre-cut in outer stiff layer 76 while barrier layers 78 and/or 80 are left intact. Alternatively, and with reference to FIG. 7, top lid 72' has an aperture 88' partially cut in outer stiff layer 76' leaving barrier layers 78' and/or 80' intact. The portion of uncut outer stiff layer 76' leaves an attachment hinge 89, the purpose of which to be explained hereinafter.

Referring back to FIGS. 5 and 6, easy-open/reclosing device generally indicated as 90, which is shown after it has been applied to top lid 72 in FIG. 6, comprises base portion 92, movable portion 94, and hinge 96 connecting the two. Alternatively, hinge 96 can be eliminated thereby making movable portion 94 separable from base portion 92.

Base portion 92 includes a dispensing aperture 98 shaped complementary to lid aperture 88 or 88', and a flange 100 encircling dispensing aperture 98 and projecting downwardly from base portion 92. Flange 100 includes a notch 102 of particular significance. When device 90 is applied to top lid 72 as shown in FIG. 6, flange 100 breaks barrier layer 78 and/or barrier layer 80 to open container 70. However, the portion of layer 78 and/or 80 that corresponds to notch 102 in flange 100 does not break, which leaves an attachment hinge 104 connecting top lid 72 to broken-out section 106. If device 90 is applied to top lid 72' shown in FIG. 7, flange 100 breaks barrier layer 78' and/or 80' except for the portion below attachment hinge 89, which corresponds to notch 102 and remains intact to connect broken-out section 106' to top lid 72'.

As shown in FIG. 6, flange 100 of device 90 has been pressed into and firmly engages dispensing aperture 88 while broken-out section 106 has rotated out of the way.

Preferably, flange 100 has a step or snap bead projecting from its outer surface that snaps through aperture 88 to even more firmly hold device 90 in place. The bottom edge of flange 100 may be provided with sharp teeth or serrations to reduce the amount of force necessary to break through the barrier layer(s).

Still referring to FIGS. 5 and 6, movable portion 94 includes a plug member 110 depending downwardly therefrom and a grasping tab 112 which provides a convenient means for a consumer to grasp and lift up on movable portion 94 when it is in its closed position. Plug member 110 is shaped complementary to both base aperture 98 and lid aperture 88. When movable portion 94 is in its closed position, plug member 110 enters and tightly engages base aperture 98, thereby providing a convenient means to reclose container 70 after the initial opening thereof.

Base portion 92 of device 90 also includes a deformable pouring lip/drain surface 114 that initially projects outwardly from base dispensing aperture 98 in substantially the same plane as the base portion 92 as shown in FIG. 5. When device 90 is first applied to top lid 72, the top surface of peripheral rim 75 at approximately points D and C comes into contact with the underside of pouring lip/drain surface 114 generally at points C' and D', respectively. Then, as device 90 is further pressed onto top lid 72, contact points C and D on rim 75 start to bend pouring lip 114 upward. Finally, when device 90 is firmly seated on top lid 72, rim 75 pushes the side edges of pouring lip 114 closer to one another, which gives pouring lip 114 a trough-shaped, upwardly-inclined configuration as shown in FIG. 6. So shaped, pouring lip 114 not only provides an ideal surface for channeling product up and over rim 75 when container 70 is tipped to dispensing the product therein, but also one for draining any product remaining on pouring lip 114 back into container 70 when it is returned to its upright position.

While several particularly preferred embodiments of the present invention have been described and illustrated, it will be apparent to those skilled in the art that various changes and modifications can be made without departing from the spirit and scope of the present invention. Accordingly, the following claims are intended to embrace such changes and modifications that are within the scope of the present invention.

What is claimed is:

1. An easy-open/reclosure device for application to the top lid of a container having a peripheral rim projecting upwardly therefrom, said top lid having a pre-cut or pre-scored dispensing aperture therein, said device comprising:

(a) a base portion having a dispensing aperture therethrough and a bottom surface;

(b) a flange depending downwardly from said bottom surface of said base portion and encircling said base dispensing aperture, said flange having inner and outer surfaces and a bottom edge, said flange being shaped complementary to said pre-cut or pre-scored dispensing aperture in said top lid, whereby said flange enters said pre-cut dispensing aperture or breaks through said pre-scored aperture when said device is applied to said top lid;

(c) a moveable portion having a bottom surface and open and closed positions, said bottom surface having a plug member depending therefrom, said plug member having an outer surface and being shaped complementary to said base dispensing aperture, whereby said plug member will readily enter and snugly engage said base aperture when said moveable portion is in its said closed position; and (d) a deformable pouring lip/drain surface extending outwardly from said base portion and intially lying substantially in the same plane as said base portion, said deformable pouring lip/drain surface coming into intimate contact with said peripheral rim and bending into an upwardly-inclined, trough-shaped configuration when said device is applied to said top lid of said container.

2. The easy-open/reclosure device recited in claim 1 wherein said moveable portion is hingedly attached to said base portion and said moveable portion includes an integral grasping tab.

3. The easy-open/reclosure device recited in claim 1 wherein said outer surface of said depending flange includes means for tightly securing said device to said top lid of said container.

4. The easy-open/reclosure device recited in claim 3 wherein said tightly securing means comprises a snap bead projecting outwardly from said outer surface of said flange.

5. The easy-open/reclosure device recited in claim 3 wherein said tightly securing means comprises a step projecting inwardly from said outer surface of said flange.

6. The easy-open/reclosure device recited in claim 1 wherein said outer surface of said plug member and said inner surface of said depending flange include cooperating means for securing said plug member within said base dispensing aperture.

7. The easy-open/reclosure device recited in claim 6 wherein said cooperating securement means comprises a step projecting outwardly from said outer surface of said plug and a step projecting inwardly from said inner surface of said depending flange.

8. The easy-open/reclosure device recited in claim 6 wherein said cooperating securement means comprises a snap bead projecting outwardly from said outer surface of said plug and a groove in said inner surface of said depending flange.

9. The easy-open/reclosure device recited in claim 1 wherein said bottom edge of said depending flange is provided with means for reducing the amount of force necessary to break through said pre-scored dispensing aperture in said top lid.

10. The easy-open/reclosure device recited in claim 9 wherein said force reducing means comprises pointed teeth or serrations.

11. The easy-open/reclosure device recited in claim 1 wherein said flange includes a notch, whereby said flange partially ruptures said pre-cut or pre-scored dispensing aperture when applied to said top lid and creates a broken-out section and an attachment hinge corresponding to said notch, said attachment hinge connecting said cut-out section to said top lid.

12. An easy-opn/reclosure device for application to the top lid of a container having a peripheral rim projecting upwardly therefrom, said top lid having a pre-cut or pre-scored dispensing aperture therein, said device comprising:

(a) a base portion having a dispensing aperture therethrough and a bottom surface;

(b) a flange depending downwardly from said bottom surface of said base portion and encircling said base dispensing aperture, said flange having inner and outer surfaces and a bottom edge, said flange being shaped complementary to said pre-cut or pre-scored dispensing aperture in said top lid, whereby said flange enters said pre-cut dispensing aperture or breaks through said pre-scored aperture when said device is applied to said top lid;

(c) a moveable portion having a bottom surface and open and closed positions, said bottom surface having a plug member depending therefrom, said plug member having an outer surface and being shaped complementary to said base dispersing aperture, whereby said plug member will readily enter and snugly engage said base aperture when said moveable portion is in its said closed position;

(d) a deformable pouring lip/drain surface extending outwardly from said base portion and initially lying in substantially the same plane as said base portion, said deformable pouring lip/drain surface coming into intimate contact with said peripheral rim and bending into an upwardly-inclined, trough-shaped configuration when said device is applied to said top lid of said container; and (e) at least one channel through said depending flange, said channel providing fluid communication across said depending flange.

13. The easy-open/reclosure device recited in claim 12 wherein said moveable portion is hingedly attached to said base portion.

14. The easy-open/reclosure device recited in claim 12 wherein said outer surface of said depending flange includes means for tightly securing said device to said top lid of said container.

15. The easy-open/reclosure device recited in claim 14 wherein said tightly securing means comprises a snap bead projecting outwardly from said outer surface of said flange.

16. The easy-open/reclosure device recited in claim 14 wherein said tightly securing means comprises a step projecting inwardly from said outer surface of said flange.

17. The easy-open/reclosure device recited in claim 12 wherein said outer surface of said plug member and said inner surface of said depending flange include co-operating means for securing said plug member within said base dispensing aperture.

18. The easy-open/reclosure device recited in claim 17 wherein said cooperating securement means comprises a step projecting outwardly from said outer surface of said plug and a step projecting inwardly from said inner surface of said depending flange.

19. The easy-open/reclosure device recited in claim 17 wherein said cooperating securement means comprises a snap bead projecting outwardly from said outer surface of said plug and a groove in said inner surface of said depending flange.

20. The easy-open/reclosure device recited in claim 12 wherein said moveable portion includes an integral grasping tab.

21. An easy-open/reclosure device for application to the top lid of a container having a peripheral rim projecting upwardly therefrom, said top lid being of laminate construction comprising an outer stiff layer and at least one inner barrier layer, said top lid having a pre-cut or pre-scored dispensing aperture in said outer stiff layer, said device comprising:

(a) a base portion having a dispensing aperture therethrough and a bottom surface;

(b) a flange depending downwardly from said bottom surface of said base portion and encircling said base dispensing aperture, said flange having inner and outer surfaces, a bottom edge, and a notch, whereby said flange partially ruptures said top lid when applied to said top lid and creates a broken-out section and an attachment hinge corresponding to said notch, said attachment hinge connecting said broken-out section to said top lid;

(c) a moveable portion having a bottom surface and open and closed positions, said bottom therefrom, said plug member having an outer surface and being shaped complementary to said base dispensing aperture, whereby said plug member will readily enter and snugly engage said base aperture when said moveable portion is in its said closed position; and (d) a deformable pouring lip/drain surface extending outwardly from said base portion and initially lying substantially in the same plane as said base portion, said deformable pouring lip/drain surface coming into intimate contact with said peripheral rim and bending into an upwardly-inclined, trough-shaped configuration when said device is applied to said top lid of said container.

22. The easy-open/reclosure device recited in claim 21 wherein said moveable portion is hingedly attached to said base portion.

23. The easy-open/reclosure device recited in claim 21 wherein said outer surface of said depending flange includes means for tightly securing said device to said top lid of said container.

* * * * *

UNITED STATES PATENT AND TRADEMARK OFFICE

CERTIFICATE OF CORRECTION

PATENT NO. : 4,807,787

DATED : February 28, 1989

INVENTOR(S) : J.R. Langmeier; M.N.H. Chehab; R.C.J.M. DeCaluwe; W.A.M. Hertogs; J.B.A. Van Den Broeck; M.H.J.M. Van Loon It is certified that error appears in the above-identified patent and that said Letters Patent is hereby corrected as shown below:

ON THE TITLE PAGE:

REFERENCES CITED Section, first column, "Lluffman" should read -- Huffman --.

Column 4, line 8, "of" should read -- or --.

Column 4, line 30, "eliminate" should read -- eliminated --.

Claim 12, line 58, "opn" should read -- open --.

Claim 12, line 10, "dispersing" should read -- dispensing --.

Claim 21, line 28, after "bottom" insert -- surface having a plug member depending --.

Signed and Sealed this

Twelfth Day of September, 1989

*Attest:*

DONALD J. QUIGG

*Attesting Officer*

*Commissioner of Patents and Trademarks*